US009850705B2

(12) United States Patent
Dean et al.

(10) Patent No.: US 9,850,705 B2
(45) Date of Patent: Dec. 26, 2017

(54) ENERGY EFFICIENT SHADING SYSTEMS FOR WINDOWS

(71) Applicant: University of Cincinnati, Cincinnati, OH (US)

(72) Inventors: Kenneth A. Dean, Phoenix, AZ (US); John D. Rudolph, Cincinnati, OH (US)

(73) Assignee: University of Cincinnati, Cincinnati, OH (US)

( * ) Notice: Subject to any disclaimer, the term of this patent is extended or adjusted under 35 U.S.C. 154(b) by 0 days.

(21) Appl. No.: 14/331,478

(22) Filed: Jul. 15, 2014

(65) Prior Publication Data

US 2015/0129140 A1 May 14, 2015

Related U.S. Application Data

(60) Provisional application No. 61/846,811, filed on Jul. 16, 2013.

(51) Int. Cl.

| | |
|---|---|
| ***E06B 9/40*** | (2006.01) |
| ***E06B 9/68*** | (2006.01) |
| ***E06B 9/24*** | (2006.01) |

(52) U.S. Cl.

CPC ..... *E06B 9/68* (2013.01); *E06B 9/24* (2013.01); *E06B 2009/2417* (2013.01); *E06B 2009/2452* (2013.01); *E06B 2009/6827* (2013.01)

(58) Field of Classification Search

CPC ..... E06B 9/24; E06B 2009/2405; E06B 2009/2417; E06B 2009/2423; E06B 2009/2447; E06B 2009/2452; E06B 2009/6818; E06B 2009/6827

See application file for complete search history.

(56) References Cited

U.S. PATENT DOCUMENTS

| | | | | | |
|---|---|---|---|---|---|
| 2,774,421 | A | * | 12/1956 | Lion | A47H 23/08 160/238 |
| 4,865,107 | A | * | 9/1989 | Dube | E06B 9/40 160/264 |
| 5,088,543 | A | * | 2/1992 | Bilbrey | E04D 13/033 160/239 |
| 5,205,334 | A | * | 4/1993 | Judkins | B23Q 3/15526 160/108 |

(Continued)

FOREIGN PATENT DOCUMENTS

| | | | | |
|---|---|---|---|---|
| WO | WO 2012/075369 | * | 6/2012 | A47H 23/10 |

OTHER PUBLICATIONS

Vista Window Film Products, May 2013, retrieved from (http://web.archive.org/web/20130531213721/http://www.vista-films.com/en/product-series.aspx) and (http://www.vista-films.com/pdf/Vista-Specs.pdf).*

(Continued)

*Primary Examiner* — Katherine W Mitchell
*Assistant Examiner* — Abe Massad
(74) *Attorney, Agent, or Firm* — Wood, Herron & Evans, LLP

(57) ABSTRACT

A shading assembly configured to have a first selectable state that is transmissive to more than 40% of solar light and reflects more than 35% of solar heat, a second selectable state that blocks more than 75% of the solar light and transmits more than 50% of the solar heat, and a third selectable state that transmits more than 50% of the solar light and more than 50% of the solar heat.

19 Claims, 4 Drawing Sheets

(56) References Cited

U.S. PATENT DOCUMENTS

| | | | | |
|---|---|---|---|---|
| 6,049,419 | A * | 4/2000 | Wheatley | B32B 17/10018 359/359 |
| 6,666,251 | B2 * | 12/2003 | Ikle | E06B 9/11 160/120 |
| 6,797,396 | B1 * | 9/2004 | Liu | B32B 17/10 359/359 |
| 7,059,377 | B2 * | 6/2006 | Nien | E06B 9/42 160/120 |
| 2004/0191540 | A1 * | 9/2004 | Jakobi | B05D 7/57 428/457 |
| 2007/0281170 | A1 * | 12/2007 | Seth | B32B 17/10 428/432 |
| 2009/0254222 | A1 * | 10/2009 | Berman | E06B 9/322 700/275 |
| 2010/0098943 | A1 * | 4/2010 | Temchenko | B32B 7/12 428/355 AC |
| 2012/0291965 | A1 * | 11/2012 | Marocco | E06B 9/40 160/120 |
| 2013/0128336 | A1 * | 5/2013 | Dean | E06B 9/24 359/290 |
| 2014/0335329 | A1 * | 11/2014 | Abayasinghe | B32B 27/12 428/212 |

OTHER PUBLICATIONS

Tong, J., et al; "Infrared-Transparent Visible-Opaque Fabrics for Wearable Personal Thermal Management"; Dept. of Mech Engineering, MIT.*

* cited by examiner

ENERGY EFFICIENT SHADING SYSTEMS FOR WINDOWS

CROSS REFERENCE TO RELATED APPLICATIONS

The present application claims the benefit of U.S. Provisional Patent Application Ser. No. 61/846,811, entitled, "ENERGY EFFICIENT SHADING SYSTEMS FOR WINDOWS," filed Jul. 16, 2013, the disclosure of which is incorporated herein by reference.

RELATED ART

Field of the Invention

The present disclosure is directed to window coverings such as shades and blinds, and the use of specific materials and designs to change the transmission of the solar spectrum through a window, skylight, transparent surface and/or translucent surface, and systems to optimize occupant comfort and minimize building energy usage.

Brief Discussion of Related Art

Architects add windows to structures to provide a view, a connection to the outdoors, the feeling of space, ventilation, and natural lighting. In fact, several studies have shown that natural lighting improves the comfort and productivity of occupants. However, these beneficial attributes bring issues with comfort and privacy. In particular, sunlight shining directly into windows and skylights creates extreme brightness and glare, resulting in occupant discomfort and the inability to read computer screens. Direct sunlight also produces thermal discomfort as the sun's radiant energy overwhelms the interior cooling system locally. Finally, many windows provide privacy, primarily at night, when the lighting in the structure highlights the occupants, but also sometimes during the day. Comfort and privacy are addressed with a multitude of window coverings including blinds (horizontal, vertical, Venetian, etc), shades, and curtains.

Cost is an important consideration in window covering schemes. Cost includes the one-time cost and installation of the window coverings offset by energy savings accrued over the life of the windows coverings. Energy savings are realized in the winter by providing good insulation to retain heat, and also by allowing solar energy into the building. Energy savings are realized in the summer by blocking solar heat and light, thereby reducing the cooling needs.

Buildings are generally designed to maintain a constant and comfortable temperature and employ heating and cooling systems to do so. Energy efficient buildings often make use of solar radiation for both lighting needs and temperature control. Incident sunlight brings about 1 KW/m2 of energy to the earth's surface over the wavelength range of 300 to 2500 nm. The visible range, from 300 nm to 700 nm, may be used to light a building. However, about 52% of sunlight energy lies in the near infrared wavelengths. This light is invisible and is hereby referred to as solar heat. A majority of solar heat infrared energy lies in the Infrared-A range (700-1400 nm), with nearly 50% of incident infrared energy and 25% of total solar energy lying in the 700-1000 nm range.

Buildings today primarily use passive techniques to control the incident solar radiation and ensure occupant comfort (both glare and thermal comfort) and achieve the energy efficiency status quo. Insulated walls, roofs, windows and skylights are designed to isolate the indoor climate from the outdoor climate. Passive paints have been developed to reflect infrared from building walls are roofs. These contain infrared-reflecting pigments, or infrared-transparent pigments combined with visible-region pigments on an infrared-reflecting substrate. In addition, some buildings employ designs such as fins that restrict the high summer sun from entering southern exposure windows, but allow lower angle winter sunlight to come through them, providing some seasonal adaptability. While some structures take advantage of these designs, new track home developments, for example, place the same several floor plans on each lot regardless of sun orientation. Consequently, while efficient passive components are available, efficient design and implementation is not necessarily reaching the bulk of the population. Federal Energy Star guidelines have attempted to set performance levels in order to drive improved efficiency.

For windows, several technology-based solutions for manipulating solar heat gain and minimizing thermal heat transfer have been successfully deployed in recent decades. For example, low emissivity coatings applied to the inside surface(s) of dual pane windows restrict thermal transfer across the insulating gas gap. These coatings, often multilayer insulator/silver thin films, reflect thermal infrared in the 8 to 10 micrometer range (25° C. peaks at 9.7 micrometers). In cool climates, windows have this film on the inside pane to reflect the heat back inside. In hot climates, a slightly different coating with high reflectivity matched to the near infrared solar wavelength (700-1200 nm) is used to reject the infrared part of the solar spectrum. This reduces the cooling load of the building. Additional strategies include windows with compositions or coatings that absorb or reflect both the visible and near-infrared parts of the spectrum. Tints in various hues and reflective coatings are examples. Aftermarket coatings on plastic are available for applying to window surfaces, including low e-coatings, near-infrared-reflecting coatings, tinted coatings and reflective coatings.

A key weakness of passive techniques for controlling solar heat gain is that a one-sized solution does not fit all. In many climates, solar heat gain should be maximized in the winter, but minimized in the summer. In dry climates where the temperature varies by 30 degrees each day, the solar heat gain should be maximized in the 45° F. morning and minimized in the 75° F. afternoon.

Federal Energy Star guidelines set performance requirements for windows in different climate zones within the United States that can generally only be achieved with dual pane window designs and passive windows coatings that reduce transmission of visible and infrared light. Energy Star divides the United States into four regions. Windows built for Napa Valley have the same coating requirements as those built for El Paso and Atlanta, even though the climates are remarkably different. Wherever we can better match the diurnal, seasonal, and regional solar heat gain to a building's needs, we improve our energy efficiency.

Active window solutions promise further improvements, but at significant cost. Active coatings such as thermochromic or photochromic materials are relatively inexpensive. However, photochromic responds to the UV part of the spectrum, so windows will tint in the winter when solar heat gain is desired. Thermochromic materials are not transparent and are generally hazy. Smart windows technologies have also been deployed, particularly electrochromic technology. Electrochromic technology tints both the visible and near-infrared spectrum, providing occupant comfort from glare and excessive heat. However, controlling heat and light separately is not possible, so thermal comfort also means higher lighting costs. Moreover, at nominally $100 per square foot, these windows are far too expensive to realize a return on investment based on energy savings.

The status quo solution for active control of sunlight through a window remains an assortment of blinds, curtains, and shades. Generally these window coverings are under manual control, and are not optimally operated to reduce energy usage. Commercial buildings, particularly ones designed for LEED or Net Zero Energy are beginning to employ motorized shades that track the Sun, as well as daylighting electrical systems. These daylighting systems place the lights in the outer sunlit perimeter of the building on different circuits so that these lights can be dimmed when the sun provides daylighting. This improvement alone can account for a 30% lighting energy savings. However, the status quo window covering solutions designed to reduce glare and solar heat, also reduce the visible light transmission, resulting less efficient energy usage.

What is lacking is an inexpensive technology to actively manage the total solar spectrum (e.g., near infrared and visible) through windows by time of day, season and region. To maximize energy efficiency throughout the seasons for heating, cooling and lighting, it is desirable to independently manage the infrared and visible regions, because consumers could utilize the visible light without the infrared heat or infrared heat without the visible light.

INTRODUCTION TO THE INVENTION

The disclosure provides methods, systems, devices and/or apparatuses related to reflecting and/or allowing transmission of the visible and infrared region of the solar spectrum. Specifically, the disclosed methods, systems, devices and/or apparatuses relate to selectively reflecting or transmitting the visible and infrared spectrum independent of other regions of the solar spectrum.

Specifically, the disclosure provides a technology for active management of solar heat gain through windows, skylights, and transparent/translucent apertures. More specifically, surfaces are provided that modulate near-infrared reflection, transmission, and/or absorption properties, in some embodiments in response to the heating and cooling needs of a building while providing visible light when required. These active surfaces are introduced into a shading system that may be applied to windows and skylights. In some embodiments, "smart" surfaces may be tied directly into building HVAC systems and/or they may operate autonomously through solar power and a sensor/algorithm system.

It is a first aspect of the present invention to provide a shading assembly configured to have a first selectable state that is transmissive to more than 40% of solar light and reflects more than 35% of solar heat, a second selectable state that blocks more than 75% of the solar light and transmits more than 50% of the solar heat, and a third selectable state that transmits more than 50% of the solar light and more than 50% of the solar heat.

In a more detailed embodiment of the first aspect, the shading assembly in at least one of the first selectable state and the second selectable state is operative to overlap a viewable portion of a window. In yet another more detailed embodiment, the shading assembly in at least one of the first selectable state and the second selectable state is operative to overlap a viewable portion of a skylight. In a further detailed embodiment, a haze of at least one of the first and second selectable states is less than 5%. In still a further detailed embodiment, a haze of at least one the first and second selectable states is less than 2%. In a more detailed embodiment, the shading assembly includes a first roller shade. In a more detailed embodiment, the first roller shade includes at least one of a near-infrared reflective property and a visible light non-transmitting property. In another more detailed embodiment, the shading assembly includes a second roller shade, and the second roller shade includes at least one of a near-infrared reflective property and a visible light non-transmitting property. In yet another more detailed embodiment, the shading assembly includes a blind, and the blind includes at least one of a near-infrared reflective property and a visible light non-transmitting property.

In yet another more detailed embodiment of the first aspect, the assembly further includes a control system including a component comprising at least one of an interior climate sensor monitoring an interior climate, an exterior climate sensor monitoring an exterior climate, a timing circuit, and a microprocessor programmed with climate control algorithms, where the component supplies a controlling signal for selecting at least one of the first, second, and third selectable states. In yet another more detailed embodiment, the control system selects at least one of the first, second, and third selectable states responsive to a position of the sun. In a further detailed embodiment, the control system selects at least one of the first, second, and third selectable states responsive to a time of a day. In still a further detailed embodiment, the control system selects at least one of the first, second, and third selectable states responsive to a season. In a more detailed embodiment, the control system selects at least one of the first, second, and third selectable states responsive to a temperature on an interior of a building. In a more detailed embodiment, the control system selects at least one of the first, second, and third selectable states responsive to a visible light intensity on an interior of a building. In another more detailed embodiment, the modifying the selectable states in response to sensor input reduces the energy consumption of a building's in at least one area of lighting, cooling or heating.

It is a second aspect of the present invention to provide a solar energy management device comprising: (a) a first repositionable shade including a near-infrared reflective property; (b) a second repositionable shade including a visible light non-transmitting property, where the first repositionable shade is operative to reflect near-infrared light and transmit visible light, where the second repositionable is operative to transmit near-infrared light and reject transmission of visible light, and where the first and second repositionable shades may be deployed concurrently to at least partially overlap one another and may be deployed individually.

It is a third aspect of the present invention to provide a method of manipulating solar energy transmission through a surface, the method comprising: (a) deploying at least one of at least two shades to cover at least a portion of a translucent surface of a building, where a timing of the deploying step accounts for at least one of a time of day, a time of year, and a temperature on an interior of the building, where the deploying step includes choosing from the at least two shades that are adjacent to the translucent surface of the building, where a first shade is operative to transmit near-infrared light and reject transmission of visible light, and where a second shade is operative to reflect near-infrared light and transmit visible light, and where the first shade and the second shade may be concurrently deployed to overlap one another so that a majority of a directly-incident near-infrared light is reflected and a majority of a directly-incident visible light is rejected prior to reaching the translucent surface of the building.

In a more detailed embodiment of the third aspect, the deploying step includes deploying at least one of the at least two shades to overlap a majority of the translucent surface of the building. In yet another more detailed embodiment, energy consumption of the building is reduced by at least three percent during a period of deployment in which at least one of the at least two shades is deployed.

BRIEF DESCRIPTION OF THE DRAWINGS

The foregoing and other features of the present disclosure will become more fully apparent from the following description taken in conjunction with the accompanying drawings. Understanding that these drawings depict only exemplary embodiments in accordance with the disclosure and are, therefore, not to be considered limiting of its scope.

DETAILED DESCRIPTION

The exemplary embodiments of the present disclosure are described and illustrated below to encompass window coverings such as shades and blinds, and the use of specific materials and designs to change the transmission of the solar spectrum through a window, skylight, transparent surface and/or translucent surface, and systems to optimize occupant comfort and minimize building energy usage. Of course, it will be apparent to those of ordinary skill in the art that the embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
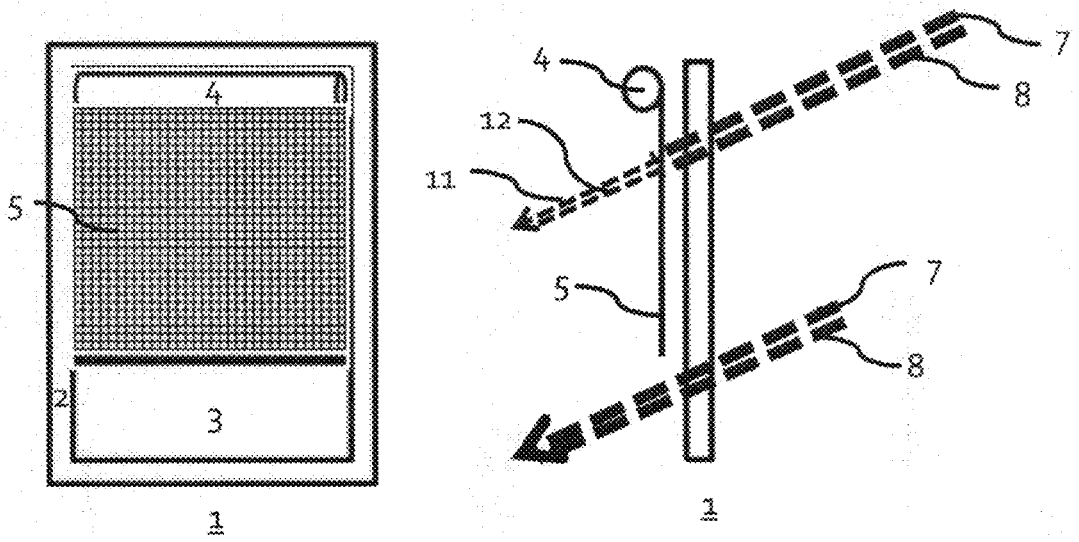
PRIOR ART FIG. 1
FIG. 1 comprises a front view of a prior art roller shade and a cross-sectional schematic of the shade in front of the window showing schematically the transmission and reflection of the solar spectrum.

Referencing FIG. 1, a prior art roller shade solution 1 is depicted, comprising a window with frame 2, a roller shade roller 4, and a roller shade material 5. The roller shade material 5 is partially deployed, leaving a window area 3 un-shaded. A side cross-sectional view is also depicted showing the solar heat 8 and solar light 7 components of the solar flux impinging on the window. The un-shaded portion of the window passes a significant amount of both solar heat 8 and solar light 7. The roller shade material 5 attenuates the transmission of both solar components 7, 8 resulting in a smaller transmitted amount of solar heat 11 and solar light 12. Typically, roller shade materials 5 transmit between 5% and 15% of the solar spectrum, depending on the weave and the coatings. Preexisting roller shade materials can be woven to manage light in three ways: 1) to allow the direct passage of light, providing some transparency; 2) to allow diffuse passage of light, providing translucency and privacy; or 3) to block all light, providing privacy. Preexisting roller shade materials 5 may have reflective coatings on an exterior-facing side to reflect visible and infrared light. International patent application publication W02012075369 describes a roller shade cloth weave with a reflective yarn coated with a near-infrared transparent black coating, which provides some reflection of solar heat that would otherwise be absorbed by the roller shade cloth material.

Roller shades of this type are sometimes employed in office buildings as motorized shades, particularly on curtain window walls, along with a daylighting system with perimeter-zone lights on controlled circuits. The building, either via time or sensor output, adjusts the shades to maximize light and minimize glare throughout the day. The use of daylighting reduces energy costs.

The shortcomings of these preexisting technologies include: 1) the inability to transmit meaningful solar heat in the winter, while concurrently providing comfort from glare; 2) the inability to block solar heat alone in the summer (cooling efficiency), while providing maximum daylighting efficiency (lighting efficiency) and viewability; 3) the inability to block substantial solar heat in the summer across the entire window area, while also providing glare control only over the window area needed; and, 4) the ability of a single system to provide the advantages of 1, 2, and 3.

The following examples illustrate particular properties and advantages of the exemplary embodiments.

Example 1

Referring to FIG. 1, a first exemplary embodiment comprises a window system 10 that is well-suited for climates which have a balance of heating and cooling needs through the year. Denver is an example city, with winter heating needs and summer cooling needs. It is significant that U.S. Federal Energy Star Guidelines for this climate do not call for near infrared-reflecting low-e coatings. The window system 10 includes a window and frame 2, and two roller shades 4 and 6. The first window shade material 16 closest to the window, and coupled to the roller 4, is a near-infrared-reflecting transparent material. The second window shade material 15 is a near-infrared transparent black material coupled to the other roller 6. Each shade can be fully deployed, partially deployed, or not deployed, providing a range of combinations of transmission and reflection for visible light and light in the near-infrared spectrum. In a side cross-sectional view, incoming solar heat 8 is reflected 13 by near infrared-reflecting solar shade 16. Where the two shades 15, 16 overlap, the incident solar heat 8 is reflected, and the visible light is absorbed. But this is one of three possible options. The second option is to roll up the first window shade material 16 and roll down the second window shade material 15 so that solar heat 11 passes through the second window shade and into the building, but solar light 12 is absorbed by the second window shade. Finally, when neither shade material 15, 16 is deployed, both solar heat 11 and solar light 12 pass into the building.

Figure 3:
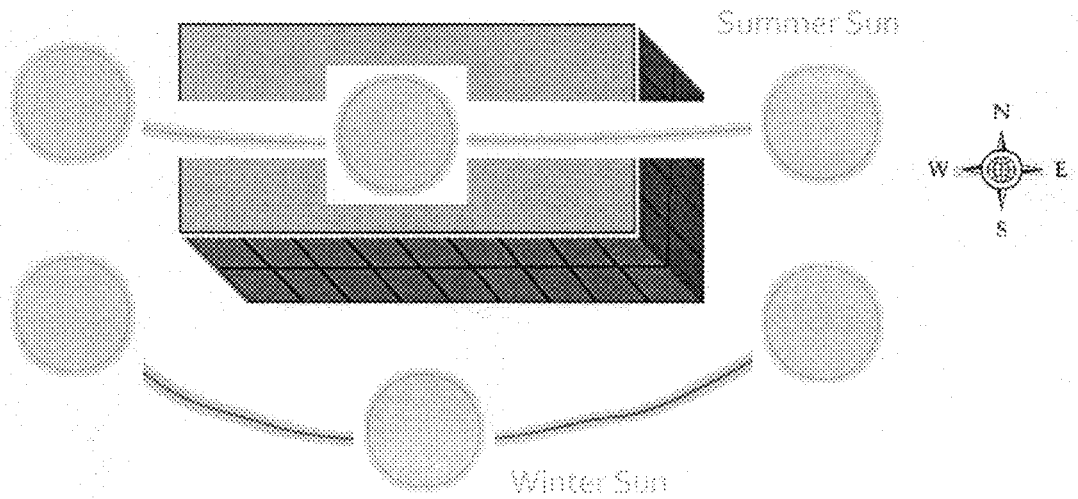
FIG. 3 comprises a schematic showing the sun's trajectory over a building with large area window walls as a function of the time of day and the season.

As shown in FIG. 3, the movement of the sun during the day across an exemplary building changes depending upon the season. In the summer morning, the sun shines directly into the east-facing windows, creating problems with glare, thermal comfort, and cooling load. In the midday, the direct sun is no longer an issue, but background solar heat, reflected from the environment, shines through the windows, adding heat as well as light. In the afternoon, the sun shines directly into the west-facing windows, creating problems with thermal comfort, glare, and cooling load. But in the winter, the sun is lower in the horizon. The sun shines directly into the east-facing windows, creating problems with glare while providing heat. In the mid-day, the direct sun continues to shine through southern-facing windows (in the northern hemisphere), creating problems with glare while adding heat and light. In the afternoon, the sun shines directly into the west-facing windows, creating problems with glare, while providing heat and light.

Figure 2:
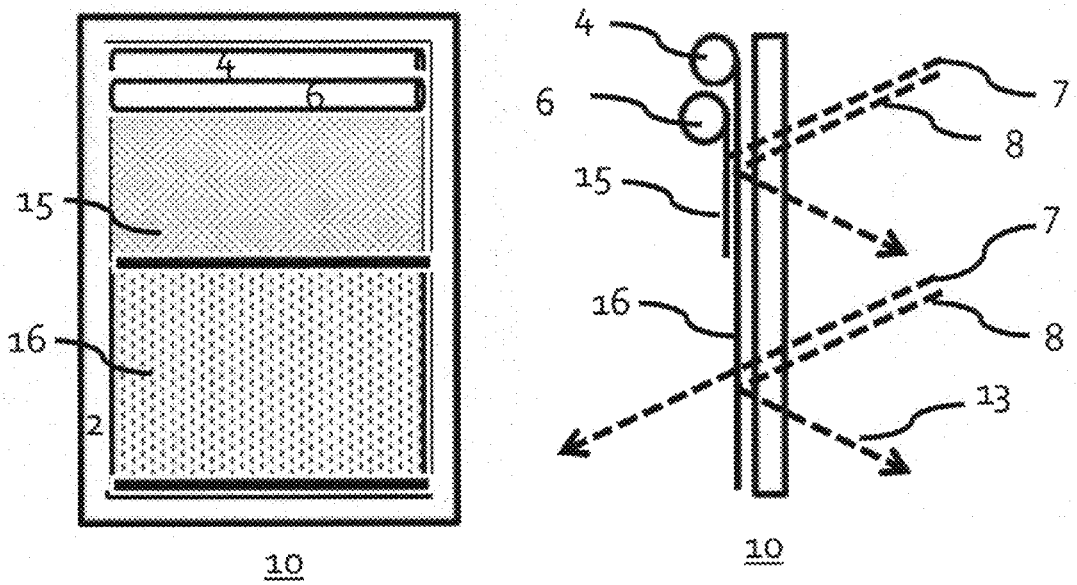
FIG. 2 comprises a front view of a dual roller shade system and a cross-sectional schematic of the shade system in front of the window showing schematically the transmission and reflection of the solar spectrum in an exemplary embodiment of the present disclosure.

Referring back to the system 10 of FIG. 2, the roller shade materials 15, 16 can be employed to maximize the energy efficiency when deployed according to the needs of the building and occupants. This is most effectively done when the rollers 4, 6 are automated, but manual control can also be employed. An exemplary sequence for automated or manual control of the rollers 4, 6 for a plurality of windows of a building is as follows: (a) in the summer, the rollers 4 associated with windows on all sides of the building operated to deploy the first window shade material 16 to reject solar heat at all times. In addition, the second rollers 6 for windows on the east side of the building are operated to deploy the second window shade material 15 in the morning to attenuate direct solar light, thereby reducing glare and reducing the cooling load by keeping the residual absorbed energy due to visible light near the window. In an automated system, the control of the rollers 4, 6 tracks the position of the sun thereby partially deploying to maximize light, while blocking glare. Moreover, the second rollers 6 for windows on the west side of the building are operated to deploy the second window shade material 15 during the afternoon and evening to attenuate direct solar light, thereby reducing glare and reducing the cooling load by keeping the absorbed heat near the window. At night, the second rollers 6 for all windows of the building may be operated to deploy the second window shade material 15 to provide privacy. B) In the winter, the first window shade material 16 may not be deployed, particularly in cases where the building heating needs have not been met. The second rollers 6 for windows on the east and south sides are operated in the mornings to deploy the second shade material 15 to attenuate direct solar light, thereby reducing glare while allowing solar heat in, and maximizing lighting. During the day, the second rollers 6 for windows on the south side are operated to deploy the second shade material 15 to block direct exposure from the low sun. The second rollers 6 for windows on the west and south sides are operated during the afternoon and evening to deploy the second shade material 15 to attenuate direct solar light, thereby reducing glare while continuing to allow solar heat and maximum light in. At night, second rollers 6 for all windows may be operated to deploy the second shade material 15 to provide privacy. The first shade material 16 may also be deployed to add an additional layer of insulation between the window and the remaining interior of the building, thereby improving the effective insulation U-factor of the window system. It should be noted that having these shade materials 15, 16 between the window and the room provide an additional insulation factor. C) In other seasons, the rollers 4, 6 may be operated to selectively deploy the shade materials 15, 16 to respond to the transitional energy needs of the building. This shade system 10, when used in combination with a day lighting system (controlled electrical light fixtures) may save as much as 30% of lighting electricity.

Real buildings are more complicated than the example building above, but the concept of deploying the blinds in a cooperative manner to reduce glare while managing light and heat input holds for more sophisticated control algorithms In Example 1, two shade materials 15, 16, each on a separate roller 4, 6, are employed to modulate the solar heat 11 and light 12. In exemplary form, each shade roller 4, 6 may be under independent motor control. In an alternate exemplary embodiment, a single motor may drive both rollers 4, 6. This can be accomplished, for example, through a clutch system connected to electrical relays that engage each roller independently, which operates to further reduce cost. Positional feedback of the rollers 4, 6 (i.e. where the end of the shade material is with respect to the roller or window) can also be implemented with sensors in or near the roller or window. This may be particularly useful in the case of power failures.

Figure 4:
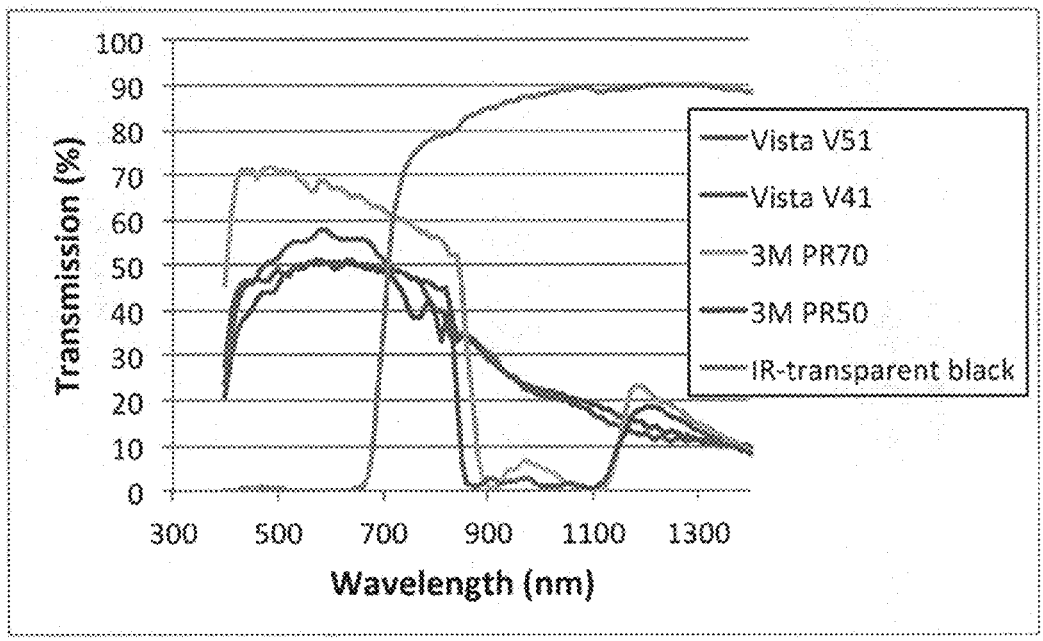
FIG. 4 is a graph of the transmission properties of exemplary shading materials across part of the solar spectrum.
Figure 5:
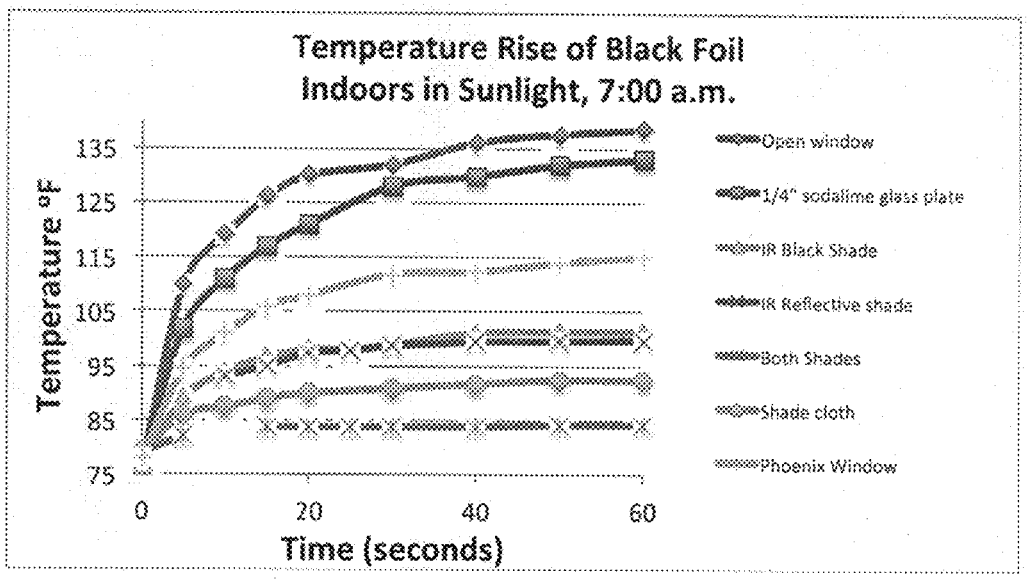
FIG. 5 is a graph showing the effect of shading materials on the temperature increase of surfaces within a building.

The shade materials 15, 16 are important for increasing or maximizing efficiency, accordingly it is desirable to have materials with optical cut-offs near at the boundary of visual light perception (700 nm). As depicted in FIG. 4, the transmission of several types of potential shade materials, in plastic sheet form factors, are shown. The infrared-transmitting material for second shade material 15 may have a transmission cut-off right at 700 nm. In short, this second shade material 15 may transmit almost all solar heat 11, but no solar light 12. For this exemplary system 10, the second shade material 15 may transmit greater than 40% of incident solar heat 11, and more preferable greater than 60% of incident solar heat. The second shade material 15 may be haze free, meaning that as the sun is rising, it is possible to see the landscape clearly, except under heavy tint. Yet, when deployed at night, the second shade material 15 may provide strong privacy. Tinting in the range of 0.5% to 5% transmission appears to provide premium glare control and privacy. The second shade material 15 may also include decorative or other functional elements such as a non-uniform screen-like pattern, shapes and designs defined by patterns of higher density pigments, infrared-transparent pigments (i.e. Cu-pthalocyanine) that partially absorb the visible spectrum to create a colored infrared-transparent shade, or combinations of these elements Next, turning our attention to the infrared-reflecting but transparent shade materials 16, the 3M Prestige series of films uses multiple polymer layers to create an infrared reflector tuned to a specific wavelength. The PR70 and PR50 films shown in FIG. 5 are functional, but may not necessarily be ideal, because the near infrared cut-off lies in the 840-860 nm range, which is above the visual threshold of 700 to 750 nm. For this exemplary system 10, shade 16 may reject greater than 35% of the solar heat, and more preferably greater than 60% of solar heat, as measured at the integrated average energy between 700 nm and 1400 nm. Concurrently, the visible transmission (400-700 nm) may exceed the near infrared transmission (700-1400 nm), and may be greater than 50% visible transmission, and more specifically greater than 70% transmission. For the 3M PR70, the visible transmission exceeds 70%, which provides efficient lighting. This type of film, described in U.S. Pat. No. 6,049,419 with a more suitable reflection window for this application, and for applications in automotive windshields (U.S. Pat. No. 6,797,396), and glazing window units (U.S. Pat. No. 6,797,396 and US 20070281170A1), all incorporated as references herein, is comprised of multiple polymer layers that provide a reflective property in the near infrared spectrum.

The Vista brand of polymer films employ the silver-insulator multilayer low-e coating desired to reflect thermal infrared in the 8 micrometer to 10 micrometer range. The films may not be efficient infrared reflectors in the near infrared spectrum, but do provide benefits. Without proper edge treatment, these films may oxidize in humid environments, so care may be taken when using them as shade material.

The first shade materials 16 that are transmissive in the visible light range may have haze values of less than 20%, and more specifically, less than 5%, and even more specifically less than 2%. Haze may be defined as the percent of forward directed light transmitted through a sample that is scattered more than 2.5 degrees from the incident light direction.

Non-limiting example materials for the base material for the first and second shade materials 15, 16 include transparent plastics that have been stabilized for sun exposure, such as compositions of acrylic, PMMA, polyester, and PET. The individual films and the combination of these films may provide the benefits discussed above.

Referring to FIG. 5, a graph is created the depicts the results from an experiment where black foil samples were placed inside a building while the sun rose on the eastern horizon. The sun's rays were incident through various films and window conditions and the resulting temperature rise over time was measured on the foil samples. An open window allowed the temperature to rise by 60° F. in one minute. Each of the shade materials 15, 16, a near-IR transparent black and 3M PR70 IR reflective transparent sheets, allow the temperature to rise by only about 20° F. Each shade material 15, 16 cut approximately half of the radiant solar energy, although opposite regions of the solar spectrum, hence, their effect individually is approximately the same. The combination of both shade materials 15, 16 reduces the temperature rise to only 10° F., cutting off almost all the radiant solar energy.

Example 2

A second exemplary application for the dual shade materials 15, 16 and rollers 4, 6 is as a covering for a skylight. A spring system and/or a spring a track system allows roller shades to function even when completely horizontally disposed. In this alternate exemplary embodiment, the skylight lies in Las Vegas, which has a climate that benefits from heating in the winter and cooling in the summer. The temperature in Las Vegas can exceed 110° F. in the summer, so heat rejection is particularly important, while haze-free viewing through the skylight is desirable.

Figure 6:
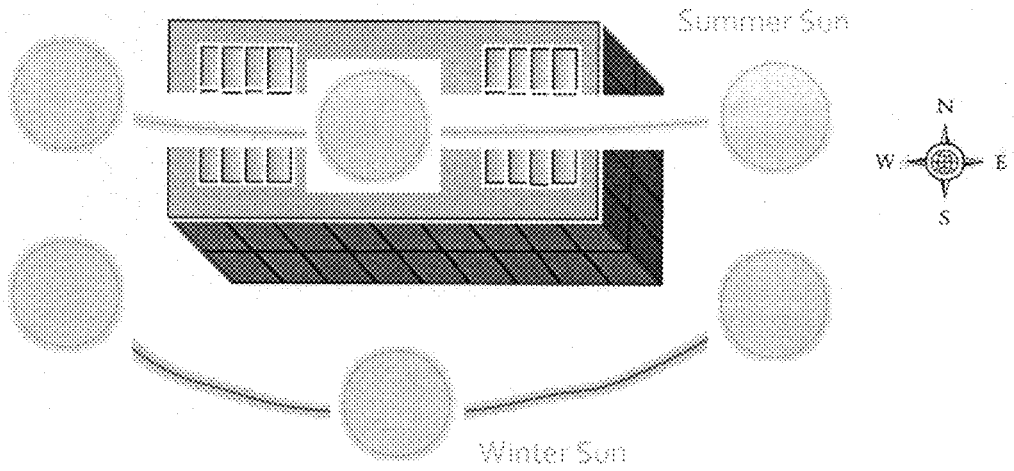
FIG. 6 comprises a schematic showing the sun's trajectory over a building with skylights as a function of the time of day and the season.

Referencing FIG. 6, a schematic is depicted representative of the travel of the sun over a rooftop in Las Vegas with skylights as a function of the time of day and time of year. The situation is different than for the windows because the sun shines directly through the skylights during the heat of day in the summer. In certain circumstance, it may be beneficial to reject this heat and provide visible attenuation to reduce glare. A dual shade system employing a transparent near infrared-reflecting shade 16 and an infrared-transparent tinted shade 15 provides control for this situation. By way of an exemplary algorithm, in the winter, the transparent near infrared-reflecting shade 16 may remain non-deployed until the heating needs of the building space in communication with the skylight are met. Alternatively, once the building heating needs are met during the daytime, the transparent near infrared-reflecting shade 16 may be deployed to reduce further heat gain. At night, the transparent near infrared-reflecting shade 16 may be deployed to increase the U-factor of the skylight system. In contrast, the infrared-transparent tinted shade 15 may not be deployed in the early morning to allow solar heat and solar light to pass, but be partially or fully deployed during the daytime to reduce or eliminate glare in the building. For example, at noon, the infrared-transparent tinted shade 15 is fully deployed to control glare. As the sun wanes, a control system associated with the shade 15 may track the sun, allowing more light in, thereby meeting the lighting needs without glare. In the summer, the infrared-transparent tinted shade 15 may be deployed continuously during the daytime, rejecting solar heat. For example, early in the morning the infrared-transparent tinted shade 15 may not be deployed, while partial deployment after the early morning accounts for the suns position up through full deployment in the midday. As the sun wanes, the infrared-transparent tinted shade 15 may be retracted (partially deployed) to allow some/more light in, thereby meeting the lighting needs without glare. It should be noted that some skylight applications are best served with diffuse lighting. In another alternate exemplary embodiment, the infrared-transparent tinted shade 15 may include designs or materials to create diffuse lighting, such as surface texture or scattering particles such as titania. The shades 15, 16 may also have decorative qualities.

Example 3

A third exemplary embodiment includes a shading system that manages solar heat and solar light independently, but in the context of a residential situation. Residences have several key differences from larger commercial buildings. First, the entire residence is often in the "perimeter zone" that can be sunlit effectively, and residents are more likely to accept varying light levels. Privacy control is important day and night. Building automation is used less frequently, and even when utilized, it is installed on an individual shade basis. Manual control of shades is much more common. Venetian blinds are rarely used on commercial curtain window walls, in part because they are heavy to actuate by a motor system compared to roller shades. But in residences, Venetian blinds are more easily operated manually. Residential blinds also commonly have decorative features to help integrate the blinds as part of the home decor.

Figure 7:
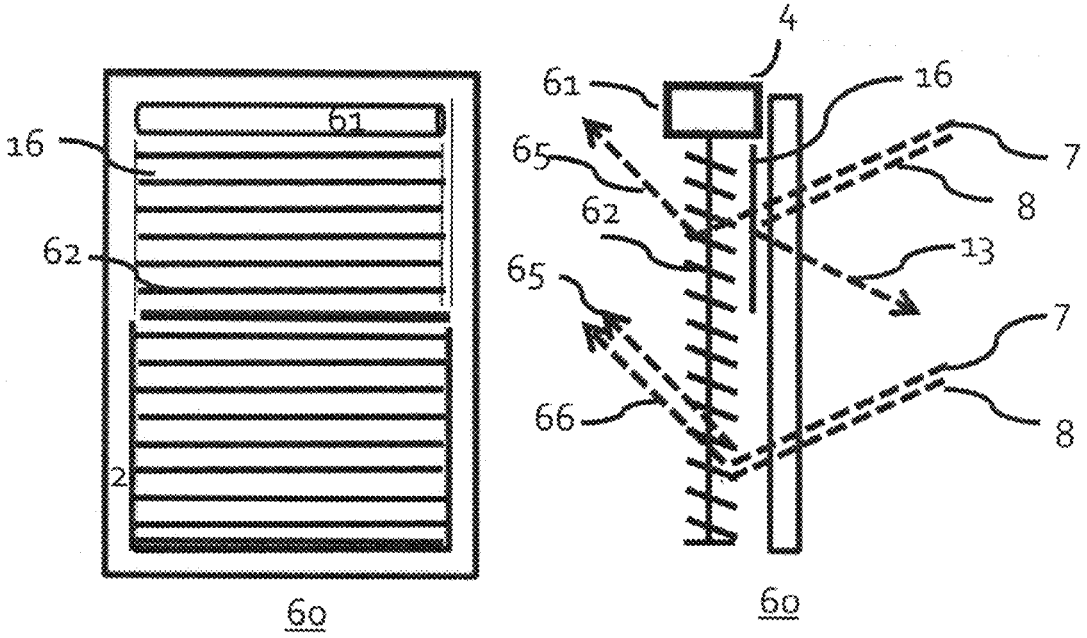
FIG. 7 comprises a front view of a roller shade and blind system and a cross-sectional schematic of the system in front of the window showing schematically the transmission and reflection of the solar spectrum in an exemplary embodiment of the present disclosure.

Referring to FIG. 7, a residential shading system 60 includes a solar heat-reflecting transparent shade 16 in combination with a Venetian blind 62 with at least one surface that is at least partially reflective to solar heat 66. The header 61 of the Venetian blind 62 conceals the roller 4 (not shown) for the shade material 16. The Venetian blinds allow daylight harvesting by re-directing light 7 that would otherwise produce glare towards the ceiling. This is a more efficient method for lighting the room in a high glare situation where the sun is shining directly into the window. When the shade material 16 is at least partially deployed, as would be the case in the summer, solar heat 13 is reflected. Changing the position of the Venetian blind 62 slats controls the amount of solar light 62 that passes through the blind, eliminating glare as needed. Privacy is obtained with complete closure of the blinds 62. Raising the blinds 62 completely (not shown) provides full viewability and full daylight harvesting. When the solar heat-reflecting transparent shade 16 is not deployed, as would be the case in the winter, both solar heat 66 and solar light 65 are transmitted to the surface of the blinds 62. Solar heat 66 is then reflected off the slats into the residence along with solar light 65, providing indirect heating. In this example, the system 60 is partially automated, with the solar heat-reflecting transparent shade 16 deploying when a local sensor determines that the outside temperature exceeds 65° F. In alternate exemplary embodiments, the degree of openness of the Venetian blinds 62 is modulated by motors within the shading system 60 in response to light intensity sensors in the header 61.

It should be noted that in a further alternate exemplary embodiment, vertical shades can replace the Venetian blinds 62. It should be noted that the Venetian blinds 62 may be exchanged, or used in combination, with a single blind although some functionality may be potentially limited. In one alternate exemplary embodiment, a sheet of infrared-reflecting and visibly-transmitting material is joined to the edge of each slat in a blind 62 (on the window side) using a bond that provides some flexibility. This system may be infrared-rejecting when the blinds are down (not drawn), and solar light, glare, and privacy are then controlled by adjusting the angle of the slats when the blinds are down. In another alternate exemplary embodiment incorporating a set of blinds, the surface of one side of a slat is infrared reflecting, the surface of the other side of the slat is infrared-absorbing, and energy usage is thereby controlled by which side of the slats is facing toward the direction of sun light. If one or more of these slats are non-transmissive in the visible spectrum, then privacy can be controlled. It is possible to create a primarily transparent set of blinds using a transparent infrared-reflecting layer, such as 3M PR70, and a transparent, but infrared-absorbing material.

It should also be noted while the above embodiments include a transparent, near-infrared-reflecting material, some energy savings benefits can be realized from a transparent shade material that rejects infrared transmission through a combination of reflection and absorption. Absorbed energy stays near the window where a sizeable percentage can be radiated back outside.

The exemplary shade systems 10, 60 described herein may incorporate at least two least shades, one of which is primarily transmissive to visible solar light and reflective to solar near-infrared light, while the other primarily blocks solar visible light and transmits solar near infrared light, each of which is independently controllable. The system is operated to control deployment of the shades to obtain improved comfort and energy efficiency, which can be manual, automated, or a combination of both. In a more sophisticated embodiment, the deployment of the shades can be controlled at the individual shade level with logic and timers and/or sensors embedded in the shading element. Individual shades can utilize power from building power, batteries, or solar cells mounted in the vicinity of the window/skylight/surface.

Figure 8:
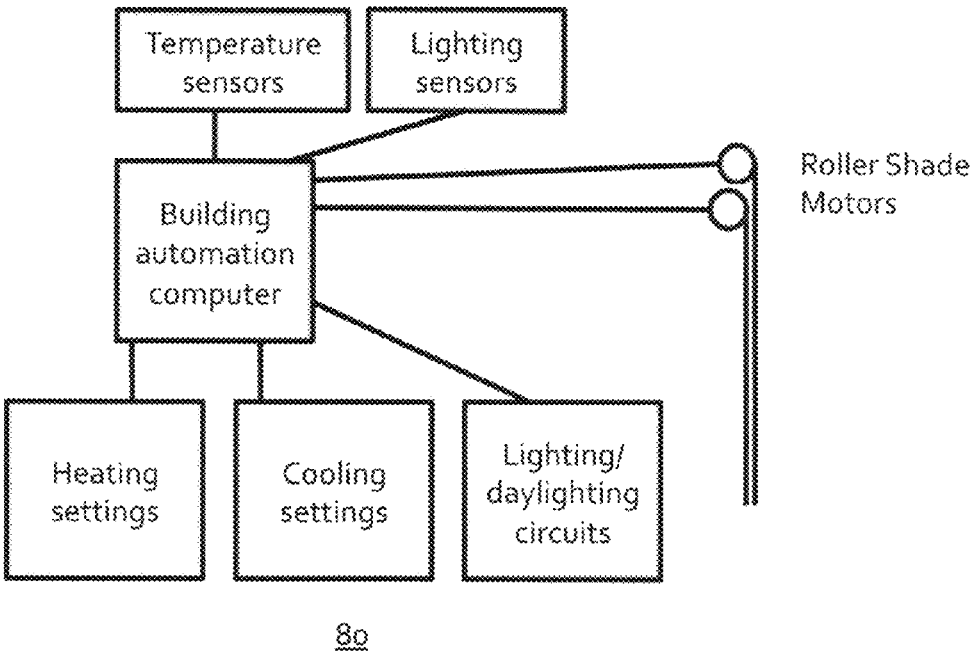
FIG. 8 is a schematic of a building control system incorporating an exemplary shading system in accordance with the instant disclosure.

Referring to FIG. 8, a schematic of an exemplary control system 80 for use with the foregoing shade systems 10, 60 incorporates an automated, computerized controller 81. This automated system 80 has control over the shading elements (roller shade motors in this example) 82, and may also have control over or feedback from the building heating setpoints 83 and cooling setpoints 84 for various zones, and well as the lighting system 85. The automated control system 80 may receive feedback from one or more of temperature sensors 86 and light sensors 87 located within the building, outside the building, or in a combination of these locations. The computerized controller 81 may also be provided with climate data, including the position of the sun as a function of the time of year.

To provide additional context for various aspects of the present disclosure, the following discussion is intended to provide a brief, general description of a suitable computing environment in which the various aspects of the control system 80 may be implemented. While an exemplary embodiment of the disclosure relates to the general context of computer-executable instructions that may run on one or more computers/peripherals/devices, those skilled in the art will recognize that the control system 80 may also be implemented in combination with other program modules and/or as a combination of hardware and software.

Generally, program modules may include routines, programs, components, data structures, etc., that perform particular tasks or implement particular abstract data types. Moreover, those skilled in the art will appreciate that aspects of the disclosure may be practiced with other computer system configurations, including single-processor or multiprocessor computer systems, minicomputers, mainframe computers, as well as personal computers, hand-held wireless computing devices, microprocessor-based or programmable consumer electronics, and the like, each of which can be operatively coupled to one or more associated devices. Aspects of the disclosure may also be practiced in distributed computing environments where certain tasks are performed by remote processing devices that are linked through a communications network. In a distributed computing environment, program modules may be located in both local and remote memory storage devices.

A computerized controller 82 may include a variety of computer readable media. Computer readable media may be any available media that can be accessed by the computer and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD ROM, digital video disk (DVD) or other optical disk storage, magnetic cassettes, magnetic tape, magnetic disk storage or other magnetic storage devices, or any other medium which may be used to store the desired information and that may be accessed by a computer.

An exemplary environment for implementing various aspects of the disclosure may include a computer that includes a processing unit, a system memory and a system bus. The system bus couples system components including, but not limited to, the system memory to the processing unit. The processing unit may be any of various commercially available processors. Dual microprocessors and other multi processor architectures may also be employed as the processing unit.

The system bus may be any of several types of bus structure that may further interconnect to a memory bus (with or without a memory controller), a peripheral bus, and a local bus using any of a variety of commercially available bus architectures. The system memory may include read only memory (ROM) and/or random access memory (RAM). A basic input/output system (BIOS) is stored in a non-volatile memory such as ROM, EPROM, EEPROM, which BIOS contains the basic routines that help to transfer information between elements within a computer, such as during start-up. The RAM may also include a high-speed RAM such as static RAM for caching data.

A computer for use with the embodiments of the instant disclosure may further include an internal hard disk drive (HDD) (e.g., EIDE, SATA), which internal hard disk drive may also be configured for external use in a suitable chassis, a magnetic floppy disk drive (FDD), (e.g., to read from or write to a removable diskette) and an optical disk drive, (e.g., reading a CD-ROM disk or, to read from or write to other high capacity optical media such as the DVD). The hard disk drive, magnetic disk drive and optical disk drive may be connected to the system bus by a hard disk drive interface, a magnetic disk drive interface and an optical drive interface, respectively. The interface for external drive implementations includes at least one or both of Universal Serial Bus (USB) and IEEE 1394 interface technologies.

The drives and their associated computer-readable media may provide nonvolatile storage of data, data structures, computer-executable instructions, and so forth. For the computer, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing the methods/instructions of the disclosure.

A number of program modules may be stored in the drives and RAM, including an operating system, one or more application programs, other program modules and program data. All or portions of the operating system, applications, modules, and/or data may also be cached in the RAM. It is appreciated that the exemplary control system 80 may be implemented with various commercially available operating systems or combinations of operating systems.

It is within the scope of the disclosure that a user may enter commands and information into the control system 80 through one or more wired/wireless input devices, for example, a touch screen display, a keyboard and/or a pointing device, such as a mouse. Other input devices may include a microphone (functioning in association with appropriate language processing/recognition software as know to those of ordinary skill in the technology), an IR remote control, a joystick, a game pad, a stylus pen, or the like. These and other input devices are often connected to the processing unit through an input device interface that is coupled to the system bus, but may be connected by other interfaces, such as a parallel port, an IEEE 1394 serial port, a game port, a USB port, an IR interface, etc.

A display monitor or other type of display device may also be connected to the system bus via an interface, such as a video adapter. In addition to the monitor, a exemplary computer may include other peripheral output devices, such as speakers, printers, etc.

The computer may operate in a networked environment using logical connections via wired and/or wireless communications to one or more remote computers. The remote computer(s) may be a workstation, a server computer, a router, a personal computer, a portable computer, a personal digital assistant, a cellular device, a microprocessor-based entertainment appliance, a peer device or other common network node, and may include many or all of the elements described relative to the computer. The logical connections depicted include wired/wireless connectivity to a local area network (LAN) and/or larger networks, for example, a wide area network (WAN). Such LAN and WAN networking environments are commonplace in offices, and companies, and facilitate enterprise-wide computer networks, such as intranets, all of which may connect to a global communications network such as the Internet The computer may be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi (such as IEEE 802.11x (a, b, g, n, etc.)) and Bluetooth™ wireless technologies. Thus, the communication may be a predefined structure as with a conventional network or simply an ad hoc communication between at least two devices.

The control system 80 may also include one or more server(s). The server(s) may also be hardware and/or software (e.g., threads, processes, computing devices). The servers may house threads to perform transformations by employing aspects of the invention, for example. One possible communication between a client and a server may be in the form of a data packet adapted to be transmitted between two or more computer processes. The data packet may include a cookie and/or associated contextual information, for example. The control system 80 may include a communication framework (e.g., a global communication network such as the Internet) that may be employed to facilitate communications between the client(s) and the server(s).

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A shading assembly that provides independent control of solar visible light and solar near-infrared heat transmitted through the shading assembly to achieve at least 4 selectable states, the shading assembly comprising a first retractably shade and a second retractable shade;

wherein a first selectable state allows transmission of visible light through the shading assembly and rejects transmission of solar heat through the shading assembly through reflection, wherein a second selectable state absorbs or reflects visible solar light through the shading assembly and transmits solar heat through the shading assembly;

wherein a third selectable state transmits both visible solar light and solar heat through the shading assembly;

wherein a fourth selectable state absorbs or reflects both visible solar light and solar heat through the shading assembly;

wherein the first selectable state is transmissive to more than 40% of visible solar light and reflects more than 35% of solar heat;

wherein the second selectable state absorbs or reflects more than 75% of visible solar light and transmits more than 50% of solar heat;

wherein the third selectable state transmits more than 50% of visible solar light and more than 50% of solar heat;

wherein the fourth selectable state absorbs or reflects more than 75% of visible solar light and reflects more than 35% of solar heat;

wherein the first shade and the second shade are configured to be deployable concurrently or individually to achieve said 4 selectable states.

2. The shading assembly of claim 1, wherein the shading assembly in at least one of the first selectable state and the second selectable state is operative to overlap a viewable portion of a window.

3. The shading assembly of claim 1, wherein the shading assembly in at least one of the first selectable state and the second selectable state is operative to overlap a viewable portion of a skylight.

4. The shading assembly of claim 1, wherein a haze of at least one of the first and second selectable states is less than 5%.

5. The shading assembly of claim 2, wherein a haze of at least one the first and second selectable states is less than 2%.

6. The shading assembly of claim 1, wherein the first shade comprises a first roller shade.

7. The shading assembly of claim 6, wherein the first roller shade includes at least one of a near-infrared reflective property and a visible light non-transmitting property.

8. The shading assembly of claim 6, wherein: the second shade comprises a second roller shade; and, the first roller shade includes a near-infrared reflective property and the second roller shade includes a visible light non-transmitting property.

9. The shading assembly of claim 6, wherein: the second shade comprises a blind; and, the first roller shade includes a near-infrared reflective property and the blind rejects that transmission of visible light when the blind is in a non-transmitting state.

10. The shading assembly of claim 1, further comprising a control system including a component comprising at least one of an interior climate sensor monitoring an interior climate, an exterior climate sensor monitoring an exterior climate, a timing circuit, and a microprocessor programmed with climate control algorithms, where the component supplies a controlling signal for selecting at least one of the first, second, and third selectable states.

11. The shading assembly of claim 10, wherein the control system selects at least one of the first, second, and third selectable states responsive to a position of the sun.

12. The shading assembly of claim 10, wherein the control system selects at least one of the first, second, and third selectable states responsive to a time of a day.

13. The shading assembly of claim 10, wherein the control system selects at least one of the first, second, and third selectable states responsive to a season.

14. The shading assembly of claim 10, wherein the control system selects at least one of the first, second, and third selectable states responsive to a temperature on an interior of a building.

15. The shading assembly of claim 10, wherein the control system selects at least one of the first, second, and third selectable states responsive to a visible light intensity on an interior of a building.

16. The shading assembly of claim 10 wherein the control system is adapted to reduce the energy consumption of a building in at least one area of lighting, cooling or heating.

17. A method of manipulating solar energy transmission through a surface, using the shading assembly of claim 1, the method comprising deploying at least one of the first shade or the second shade to cover at least a portion of a translucent surface of a building;

wherein a timing of the deploying step accounts for at least one of a time of day, a time of year, and a temperature on an interior of the building;

wherein the deploying step includes choosing from the first shade or the second shade that are adjacent to the translucent surface of the building, where the first shade is operative to transmit near-infrared light and absorb visible light, and where the second shade is operative to reflect near-infrared light and transmit visible light;

and wherein the first shade and the second shade may be concurrently deployed to overlap one another so that a majority of directly-incident near-infrared light is reflected and a majority of directly-incident visible light is absorbed prior to reaching the translucent surface of the building.

18. The method of claim 17, wherein the deploying step includes deploying at least one of the first shade or the second shade to overlap a majority of the translucent surface of the building.

19. The method of claim 17 wherein energy consumption of the building is reduced by at least three percent during a period of deployment in which at least one of the first shade or the second shade is deployed.

* * * * *